US010979846B2

(12) United States Patent
Eronen et al.

(10) Patent No.: US 10,979,846 B2
(45) Date of Patent: Apr. 13, 2021

(54) AUDIO SIGNAL RENDERING

(71) Applicant: Nokia Technologies Oy, Espoo (FI)

(72) Inventors: Antti Eronen, Tampere (FI); Arto Lehtiniemi, Lempaala (FI); Jussi Leppanen, Tampere (FI); Tapani Pihlajakuja, Vantaa (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/650,190

(22) PCT Filed: Oct. 1, 2018

(86) PCT No.: PCT/FI2018/050705
§ 371 (c)(1),
(2) Date: Mar. 24, 2020

(87) PCT Pub. No.: WO2019/073110
PCT Pub. Date: Apr. 18, 2019

(65) Prior Publication Data

US 2020/0280816 A1 Sep. 3, 2020

(30) Foreign Application Priority Data

Oct. 9, 2017 (GB) ..... 1716522.6

(51) Int. Cl.
*H04R 3/00* (2006.01)
*H04S 7/00* (2006.01)
*G10K 15/12* (2006.01)

(52) U.S. Cl.
CPC ..... *H04S 7/306* (2013.01); *G10K 15/12* (2013.01); *H04R 3/005* (2013.01); *H04S 7/304* (2013.01)

(58) Field of Classification Search
CPC ..... H04S 7/306; G10K 15/12
USPC ..... 381/310, 303, 111
See application file for complete search history.

(56) References Cited

U.S. PATENT DOCUMENTS

2015/0317983 A1 11/2015 Tsilfidis et al.
2015/0380002 A1 12/2015 Uhle et al.

FOREIGN PATENT DOCUMENTS

GB 2548614 A 9/2017

OTHER PUBLICATIONS

Remaggi, Luca, et al., "Estimation of Room Reflection Parameters for a Reverberant Spatial Audio Object", AES, May 6, 2015, abstract only, 1 pg.

(Continued)

*Primary Examiner* — William J Deane, Jr.
(74) *Attorney, Agent, or Firm* — Harrington & Smith

(57) ABSTRACT

An apparatus for audio signal rendering, the apparatus including at least one processor configured to: receive at least one microphone audio signal captured by at least one microphone within a capture environment; receive at least one projection audio signal, wherein the at least one projection audio signal is a room-impulse-response filtered at least one microphone audio signal within the capture environment; receive at least one residual audio signal, wherein the at least one residual audio signal is a result of removing the at least one projection audio signal from at least one audio signal captured by a microphone array within the capture environment; and generate at least two volumetric audio signals based on the at least one microphone audio signal, the at least one projection audio signal and the at least one residual audio signal.

21 Claims, 7 Drawing Sheets

(56) References Cited

OTHER PUBLICATIONS

Van Waterschoot, Toon, et al., "Optimally Regularized Recursive Least Squares for Acoustic Echo Cancellation", Nov. 2005, In Proceedings of the Second Annual IEEE Benelux/DSP Valley Signal Processing Symposium, Antwerp, Belgium, Mar. 28-29, 5 pgs.

AUDIO SIGNAL RENDERING

CROSS REFERENCE TO RELATED APPLICATION

This patent application is a U.S. National Stage application of International Patent Application Number PCT/FI2018/050705 filed Oct. 1, 2018, which is hereby incorporated by reference in its entirety, and claims priority to GB 1716522.6 filed Oct. 9, 2017.

FIELD

The present application relates to apparatus and methods for audio signal rendering, but not exclusively for time-frequency domain audio signal rendering for volumetric audio reproduction.

BACKGROUND

Capture of audio signals from multiple sources and mixing of audio signals when these sources are moving in the spatial field requires significant effort. For example the capture and mixing of an audio signal source such as a speaker or artist within an audio environment such as a theatre or lecture hall to be presented to a listener and produce an effective audio atmosphere requires significant investment in equipment and training.

A commonly implemented system is where one or more 'external' microphones, for example a Lavalier microphone worn by the user or an audio channel associated with an instrument, is mixed with a suitable spatial (or environmental or audio field) audio signal such that the produced sound comes from an intended direction.

The general field of the technology is spatial sound capture from OZO or a similar capture device or a group of capture devices. In particular there is known and implemented spatial sound capture which, for a dedicated decoder, enables 3 degrees of freedom (3DOF) audio reproduction using headphones, a head-mounted display (HMD), and a computer (or any similar configuration such as a smart phone attached to a VR mount).

The 3DOF consists of 3 orthogonal rotations. Sensors in present HMDs can provide this 3DOF information to existing systems such as OZO Software Suite or YouTube 360. The user can then rotate the head to view different angles of the captured VR content. A 3DOF system is one therefore where head rotation in three axes yaw/pitch/roll can be taken into account. This facilitates the audiovisual scene remaining static in a single location as the user rotates their head.

An improvement or the next stage could be referred as 3-DoF+, where the system facilitates limited movement (translation, represented in Euclidean spaces as x, y, z). For example, the movement might be limited to a range of some tens of centimetres around a central location.

From existing VR applications it is evident that 6DOF greatly improves the immersion to the VR environment. 6DOF video capture and reproduction for other VR/MR/AR applications is thus expected. Thus a current research target is 6-DoF volumetric virtual reality, where the user is able to freely move in a Euclidean space (x, y, z) and rotate his head (yaw, pitch, roll). 6-DoF volumetric VR/AR (Virtual Reality/Augmented Reality) is already supported in some of the current HMDs (Head Mounted Devices) (e.g., HTC Vive).

In the following discussions "user movement" is used as a general term to cover any user movement i.e. changes in (a) head orientation (yaw/pitch/roll) and (b) any changes in user position (done by moving in the Euclidian space or by limited head movement).

One of the issues associated with volumetric audio is the generation of suitable volumetric content and the presentation of such content. In other word the problems associated with capturing and reproducing volumetric audio.

A specific problem is how to capture an audio experience within a large space using a single microphone array and still produce a high quality experience able to render a 6 degree of freedom (6-DoF) volumetric audio signal to the listener.

When recording a sound scene with a microphone array it is possible to provide the user with a 3 degree of freedom (3-DoF) experience when the listener/user turns their head to hear the sound scene around themselves. However, when the target is to produce a 6-DoF experience, a single microphone array audio is not sufficient. If the user is able to move around the scene, the relative directions (and distances) of the sounds should change during audio rendering according to the user's position. This is very difficult to achieve from a microphone array recorded signal.

Some systems propose attempting to use a close-up microphone (otherwise known as an external microphone) to record the most important sound sources in the scene (for example a direct instrument channel or vocalist microphone channel) and track their positions over time. These can then be later rendered to the user in a 6-DoF experience from the correct direction (and distance with gain attenuation and artificial reverb). This method, however, has the drawback that the 'acoustic space' of the sound scene is missing in the close mic signals. In other words the close microphone signals when spatially processed are missing reverberation caused by walls and objects in the recorded space. Moreover, sound sources that are not represented by the close microphones are not being captured.

Where the room geometry and surface materials are known, the close microphone audio signals could be reverberated using audio processing techniques similar to those applied in computer games and simulations to produce a more realistic experience. However, simulating the acoustic characteristics of a space may be computationally demanding and may not lead to sufficient perceptual similarity of the reproduced audio to the actual space.

SUMMARY

There is provided according to a first aspect an apparatus for audio signal rendering, the apparatus comprising at least one processor configured to: receive at least one microphone audio signal captured by at least one microphone within a capture environment; receive at least one projection audio signal, wherein the at least one projection audio signal is a room-impulse-response filtered at least one microphone audio signal within the capture environment; receive at least one residual audio signal, wherein the at least one residual audio signal is a result of removing the at least one projection audio signal from at least one audio signal captured by at least one further microphone within the capture environment; and generate a spatial audio signal based on the at least one microphone audio signal, the at least one projection audio signal and the at least one residual audio signal.

The processor may be further configured to: determine listener position information; and determine relative position information based on the listener position information and an audio source position information.

The processor may be further configured to determine position information associated with the at least one microphone, wherein the audio source position information may be based on the position information associated with the at least one microphone.

The processor may be further configured to receive a user input defining the audio source position information.

The spatial audio signal may be at least two volumetric audio signals.

The processor configured to generate the spatial audio signal may be further configured to generate at least two spatially located volumetric audio signals based on the relative position information.

The processor configured to generate at least two spatially located volumetric audio signals may be further configured to: apply for each of the at least one microphone audio signals an associated microphone gain based on the relative position information; and generate at least two spatially located microphone signals for each of the gain adjusted at least one microphone audio signals based on the relative position information.

The processor configured to generate at least two spatially located volumetric audio signals may be further configured to: apply for each of the at least one projection audio signals an associated projection gain based on the relative position information; and generate at least two spatially located projection signals for each of the gain adjusted at least one projection audio signals based on the relative position information.

The processor configured to generate at least two spatially located volumetric audio signals may be further configured to: apply for each of the at least one residual audio signals an associated projection gain based on the relative position information; and generate at least two spatially located residual signals for each of the gain adjusted at least one residual audio signals based on the relative position information.

The processor configured to generate at least two spatially located volumetric audio signals may be further configured to combine: the at least two spatially located residual signals; the at least two spatially located projection signals; and the at least two spatially located microphone signals, to generate at least two spatially located combined audio signals.

The processor configured to generate at least two spatially located volumetric audio signals may be further configured to generate at least two rendered audio signals based on the generated at least two spatially located combined audio signals and a listener orientation.

The at least one microphone within a capture environment may be at least one of: a lavalier microphone; a close microphone; a boom microphone; a microphone worn around the ear or otherwise close to the mouth of a user; and an internal microphone system of an instrument.

The room-impulse-response may be estimated from the at least one microphone to the at least one further microphone within the capture environment.

The apparatus may further comprise the at least one microphone for capturing the at least one microphone audio signal captured by the at least one microphone within the capture environment.

The processor configured to receive the at least one projection audio signal may be further configured to: determine the room-impulse-response; and apply a filter set with the determined room-impulse-response to the at least one microphone audio signal to generate the at least one projection audio signal.

The processor configured to receive at least one residual audio signal may be further configured to: receive at least one audio signal captured by a microphone array; subtract the at least one projection audio signal from at least one audio signal captured by a microphone array within the capture environment to generate the at least one residual audio signal.

The at least one further microphone may be a microphone array.

According to a second aspect there is provided a method for audio signal rendering, the method comprising: receiving at least one microphone audio signal captured by at least one microphone within a capture environment; receiving at least one projection audio signal, wherein the at least one projection audio signal is a room-impulse-response filtered at least one microphone audio signal within the capture environment; receiving at least one residual audio signal, wherein the at least one residual audio signal is a result of removing the at least one projection audio signal from at least one audio signal captured by at least one further microphone within the capture environment; and generating a spatial audio signal based on the at least one microphone audio signal, the at least one projection audio signal and the at least one residual audio signal.

The method may further comprise: determining listener position information; and determining relative position information based on the listener position information and an audio source position information.

The method may further comprise determining position information associated with the at least one microphone, wherein the audio source position information may be based on the position information associated with the at least one microphone.

The method may further comprise receiving a user input defining the audio source position information.

Generating a spatial audio signal may further comprise generating at least two spatially located volumetric audio signals based on the relative position information.

Generating at least two spatially located volumetric audio signals may further comprise: applying for each of the at least one microphone audio signals an associated microphone gain based on the relative position information; and generating at least two spatially located microphone signals for each of the gain adjusted at least one microphone audio signals based on the relative position information.

Generating at least two spatially located volumetric audio signals may further comprise: applying for each of the at least one projection audio signals an associated projection gain based on the relative position information; and generating at least two spatially located projection signals for each of the gain adjusted at least one projection audio signals based on the relative position information.

Generating at least two spatially located volumetric audio signals may further comprise: applying for each of the at least one residual audio signals an associated projection gain based on the relative position information; and generating at least two spatially located residual signals for each of the gain adjusted at least one residual audio signals based on the relative position information.

Generating at least two spatially located volumetric audio signals may further comprise combining: the at least two spatially located residual signals; the at least two spatially located projection signals; and the at least two spatially located microphone signals, to generate at least two spatially located combined audio signals.

Generating at least two spatially located volumetric audio signals may comprise generating at least two rendered audio signals based on the generated at least two spatially located combined audio signals and a listener orientation.

The at least one microphone within a capture environment is at least one of: a lavalier microphone; a close microphone; a boom microphone; a microphone worn around the ear or otherwise close to the mouth of a user; and an internal microphone system of an instrument.

The room-impulse-response may be estimated from the at least one microphone to the at least one further microphone within the capture environment.

Receiving the at least one projection audio signal may further comprise: determining the room-impulse-response; and applying a filter set with the determined room-impulse-response to the at least one microphone audio signal to generate the at least one projection audio signal.

Receiving at least one residual audio signal may further comprise: receiving at least one audio signal captured by the at least one further microphone; subtracting the at least one projection audio signal from at least one audio signal captured by the at least one further microphone within the capture environment to generate the at least one residual audio signal.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
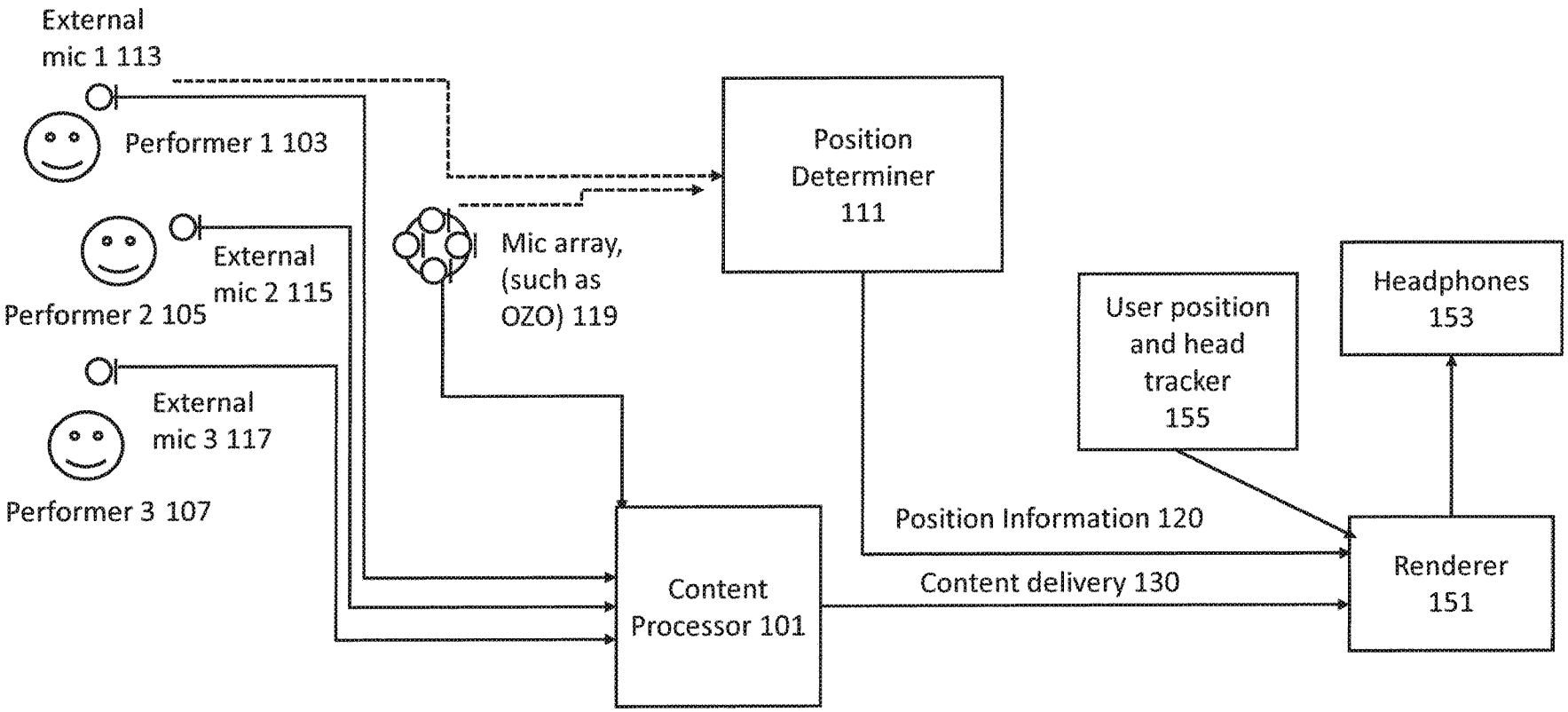
FIG. 1 shows schematically a system for implementing volumetric audio signal capture and reproduction in some embodiments.

The following describes in further detail suitable apparatus and possible mechanisms for the provision of effective volumetric audio reproduction.

The concept as described in detail hereafter presents a methods of capture, transmission and rendering or reproducing a volumetric audio experience captured using a combination of a single microphone array and close microphones (hereafter also referred to as external microphones) such that it conveniently can be experienced by the user in a 6 degree of freedom manner. In volumetric virtual reality the user will thus able to freely move in a Euclidean space (x, y, z) and rotate his head (yaw, pitch, roll). Accordingly, volumetric audio capture and rendering as implemented in the embodiments herein enable a user to listen to a captured audio scene from different positions, and the sound scene created for the user changes in different locations much as it would in a real environment.

In the embodiments as described herein apparatus for (and methods of) volumetric audio capture and initial processing may be implemented by a capture microphone array comprising at least one microphone and an external microphone. At least one room-impulse-response (RIR) may be estimated from the external microphone audio signal and the microphone array audio signal. The determined room-impulse-response may then be used to create a 'wet' version of the external microphone audio signal. The 'wet' external microphone audio signal contains the environmental effects of the audio scene, including any reflections and late reverberation. The 'wet' version of the external microphone audio signal may then be separated from the microphone array audio signal(s) to create at least one residual audio signal(s). In embodiments where all the dominant sources in the capture environment are equipped with external microphones, the residual audio signal after the separation may be mostly diffuse ambiance components of the audio scene.

The capture apparatus may then in some embodiments be configured to output for example to save for future use (recorded) or transmit for immediate use (live) the following for playback: the external microphone signal; at least one wet projection of the external microphone signal (the external microphone signal projected to at least one microphone in the microphone array); the residual of the array capture after separation; and the time-varying position & orientation of the microphone array and the external microphone.

The concept applied to the playback of the volumetric audio signals is one where during playback (rendering), the residual signal from this microphone is used as diffuse, ambiance signal during reproduction. The volumetric playback is then obtained as described in further detail in the embodiments hereafter by mixing the diffuse ambiance with sound objects created from the dry external microphone (for example lavalier microphone) audio signals and the wet projections of the external microphone audio signals, while creating the sensation of listener position change by applying distance/gain attenuation cues to the 'dry', 'wet' and residual audio signals and then adjusting the ratio in which they are combined (in other words adjusting a direct-to-wet ratio to the dry lavalier signal and the wet projection). In some embodiments the ratio may be determined such that as the 'dry' audio signal has no reverberation or room reflections a significant 'dry' audio signal corresponds to a situation where the source is very close to the listener (or the source would be in an anechoic space).

In some embodiments spatial extent processing may be applied to widen the 'wet' projection of the external microphone audio signal when the listener is far away from the source and widen the 'dry' external microphone audio signal when close to the source, and vice versa.

In some embodiments, the residual audio signal determined from the array capture after separation is processed to remove directionality information, for example, by spatial extent processing or decorrelation filtering.

In some embodiments, the 'wet' projection of the external microphone audio signal to be used is selected as the one calculated to the microphone in the microphone array that is closest to the source direction of arrival.

In the following examples the system is described with respect to a concert recording (capture) and experience (reproduction). However the same or similar methods and apparatus may be applied to the generation of volumetric audio content and reproduction of volumetric audio content.

The following examples describe a scenario of capture and playback of volumetric audio signals of a band playing on a stage. A professional capture of the band on the stage may be performed. The professional capture may utilize close microphone (external) techniques to capture each performer in high quality. Moreover a microphone array such as the one in the OZO camera may be used for spatial audio capture.

The user may then wish to reproduce or experience the concert (as described previously either as a live event or as a recorded event). To make the volumetric audio experience enjoyable. In some embodiments the rendering part can be experienced using a suitable mobile devices or personal audio player.

With respect to FIG. 1 a system is shown wherein apparatus and environment associated with a capture and playback phases of some embodiments is shown. For example FIG. 1 shows the capture environment, for example a concert hall. The capture environment may have a well defined and known geometry. In some embodiments the capture environment geometry may be estimated when performing a capture operation within the environment.

Within the concert hall (capture environment) may be an area on which the band is playing. For example as shown in FIG. 1 the area may feature a performer 1 103, a performer 2 105 and a performer 3 107.

FIG. 1 furthermore shows examples of capture apparatus which are suitable for implementing some embodiments. For example the capture apparatus may comprise external microphones which capture high quality signal of each performer. Thus for example FIG. 1 shows the capture system comprising an external microphone 1 113 associated with the performer 1 103, an external microphone 2 115 associated with the performer 2 105 and an external microphone 3 117 associated with the performer 3 107. The external microphones may be Lavalier microphones. The Lavalier microphone is an example of a 'close' audio source capture apparatus and may in some embodiments be a boom microphone or similar neighbouring microphone capture system. The Lavalier microphone may in some embodiments be a microphone array. The Lavalier microphone typically comprises a small microphone worn around the ear or otherwise close to the mouth. For other sound sources, such as musical instruments, the audio signal may be provided either by a Lavalier microphone or by an internal microphone system of the instrument (e.g., pick-up microphones in the case of an electric guitar).

FIG. 1 furthermore shows additional capture apparatus in the form of a microphone array 119 used to make a spatial audio capture. In some embodiments the microphone array 119 is a microphone array within a virtual reality capture device further comprising virtual reality camera(s), for example a Nokia OZO device. In some embodiments the microphone array 119 is a portable capture device such as a mobile phone equipped with a suitable microphone array.

In some embodiments the capture apparatus audio signals are passed to the content processor 101 for processing the audio signals for volumetric audio playback as shown in the following examples. However it is understood that in some embodiments the captured audio signals are passed to server or servers (for example as implemented in cloud based server system) and which can receive information from the playback apparatus (such as the user position and head tracker) in order to generate suitable playback audio signals which are passed directly to the playback device for presentation to the user.

In some embodiments the system further comprises a position determiner 111. The position determiner is configured to determine the position and orientations of the external microphone(s) 113, 115, 117 and the microphone array 119. The position and orientations may be determined according to any known manner. For example in some embodiments an 'indoor' positioning radio system is used wherein the external microphone is associated with a transmitter and the position determiner 111 is configured to receive the transmitted information in order to determine a direction of arrival (for example azimuth and/or elevation) and distance. Similarly in some embodiments the microphone array is associated with a similar transmitter. In some embodiments the position determiner and/or receiver is implemented within the microphone array and thus a position and/or orientation of the external microphones is determined relative to the microphone array position and orientation. In some embodiments the position and/or orientation of the external microphones are determined by analysis of the audio signals captured by the microphone array and the external microphone audio signals. The position and/or orientation of the external microphones and furthermore the microphone array may then be passed to a suitable playback device. In FIG. 1 the playback device is represented by the renderer 151 which is shown receiving the content delivery 130 from the content processor 101 and the position information 120 from the position determiner 111.

With respect to FIG. 1 a renderer 151 is shown representing at least part of a playback device. The playback device may for example further comprise headphones 153 or headset configured to be coupled (either wirelessly or wired) to the renderer 151 and further configured to output the renderer audio signals to the listener. The playback device may further comprise a user position and head tracker 155 for providing suitable 6 degree of freedom inputs for controlling the listening position.

In some embodiments playback device may be an AR apparatus or suitable VR apparatus and thus comprise the renderer 151, tracker 155 and headphones 153 in a single integrated form. The playback device may in some embodiments comprise a suitable mobile device mounted in a VR headset such as daydream viewer.

As shown in FIG. 1 the playback device may be configured to generate suitable (audio) playback experience such that the sounds captured are presented in such a manner that they 'exist' within a playback environment space.

Figure 2:
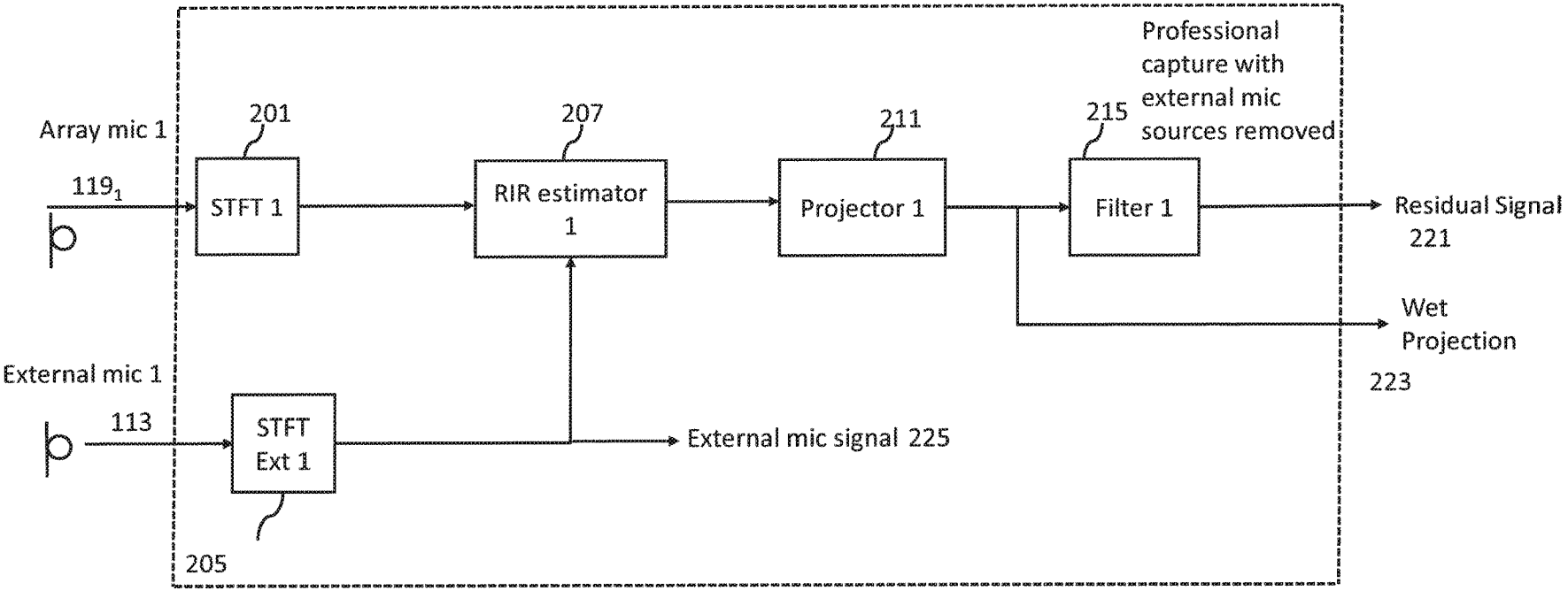
FIG. 2 shows schematically an example content processor for volumetric audio signal capture according to some embodiments.

With respect to FIG. 2 an example content processor for volumetric audio signal capture according to some embodiments is shown. The example content processor 101 is shown with respect to one of the microphone array microphones, which in FIG. 2 is referred to as Array mic 1 $\mathbf{119}_1$. However it is understood that the microphone array may comprise more than one microphone and in such embodiments the content processor may comprise parallel (or substantially parallel) signal processing for the other microphone array microphones. Similarly in the example shown in FIG. 2 the content processor 101 is shown with respect to a single external microphone, which in FIG. 2 is referred to as External mic 1 113. Similarly in some embodiments where the system comprises more than one external microphone the content processor 101 may comprise similar parallel (or substantially parallel) signal processing for the other external microphone audio signals.

The content processor 101 in some embodiments comprises suitable time-frequency domain transformers configured to receive the microphone audio signals and apply a suitable time to frequency domain transform such as a Short Time Fourier Transform (STFT) in order to convert the input time domain signals into a suitable frequency domain representation. Thus for example the array mic 1 input is coupled to STFT 1 201 which is configured to output a signal to room-impulse-response (RIR) estimator 1 207. Also External mic 1 113 input is coupled to STFT Ext 1 205 which is configured to output a signal to the room-impulse-response estimator 1 207. Furthermore in some embodiments the STFT Ext 1 205 is configured to output the 'dry' external microphone audio signal 225.

The content processor 101 may comprise room-impulse-response estimators, shown in FIG. 2 by room-impulse-response estimator 1 207 associated with the Array mic 1 input. The room-impulse-response estimator 1 207 may be configured to estimate the room-impulse-response (RIR) associated with the external microphone signals and with respect to the acoustic properties of the area (for example the room, arena, etc) within which the experience is being captured.

The generation of the room-impulse-response from the external microphone audio signal and the array microphone audio signal may be achieved in any suitable manner. For example in some embodiments the generation of the RIR may be achieved by the following operations:

Receiving the audio signals (from the external microphone and from the microphone array);

Determining the location of the external microphone (for example from the position determiner and/or from analysis of the audio signals from the external microphone and the microphone array);

Performing a block-wise linear least squares (LS) projection (for example in offline operation) or recursive least squares (RLS) algorithm (for example in either real time or offline operation) to obtain a set of RIR filters in the time-frequency domain.

The Block-wise linear least squares projection may for example be generated in some embodiments by generating a RIR as a projection operator from the external microphone audio signal (i.e. the "dry" audio signal) to the microphone array audio signal space (i.e. the "wet" audio signals).

The projection is time, frequency and channel dependent. The parameters the of RIR can be estimated using a linear least squares (LS) regression, which is equivalent to finding the projection between the external microphone audio signal (near-field) and microphone array audio signal (far-field) spaces.

The method of LS regression for estimating RIR values may be applied for moving sound sources by processing the input signal in blocks of approximately 500 ms and the RIR values may be assumed to be stationary within each block. Block-wise processing with moving sources assumes that the difference between RIR values associated with adjacent frames is relatively small and remains stable within the analysed block. This is valid for sound sources that move at low speeds in an acoustic environment where small changes in source position with respect to the receiver do not cause substantial change in the RIR value.

The method of LS regression may be applied individually for each external microphone (source) audio signal in each channel of the array. Additionally, the RIR values are frequency dependent and each frequency bin of the STFT is processed individually. Thus, in the following discussion it should be understood that the processing is repeated for all channels and all frequencies.

Assuming a block of STFT frames with indices t, . . . , t+T where the RIR is assumed stationary inside the block, the mixture signal STFT with the convolutive frequency domain mixing can be given as:

$$y=Xh$$

wherein y is a vector of external microphone (far-field) STFT coefficients from frame t to t+T;

X is a matrix containing the microphone array (near-field) STFT coefficients starting from frame t−0 and the delayed versions starting from t−1, . . . , t−D−1; and h is the RIR to be estimated.

The length of the RIR filter to be estimated may be D STFT frames. The block length is T+1 frames, and T+1> D in order to avoid overfitting due to an overdetermined model.

The above equation can be expressed as:

$$\begin{bmatrix} y_t \\ y_{t+1} \\ \vdots \\ y_{t+T} \end{bmatrix} = \begin{bmatrix} x_t & x_{t-1} & \cdots & x_{t-(D-1)} \\ x_{t+1} & x_t & \cdots & x_{t+1-(D-1)} \\ \vdots & \vdots & \ddots & \vdots \\ x_{t+T} & x_{t+T-1} & \cdots & x_{t+T-(D-1)} \end{bmatrix} \begin{bmatrix} h_0 \\ h_1 \\ \vdots \\ h_{D-1} \end{bmatrix}$$

and assuming that data before the first frame index t is not available, the model becomes:

$$\begin{bmatrix} y_t \\ y_{t+1} \\ \vdots \\ y_{t+T} \end{bmatrix} = \begin{bmatrix} x_t & 0 & \cdots & 0 \\ x_{t+1} & x_t & \cdots & 0 \\ \vdots & \vdots & \ddots & \vdots \\ x_{t+T} & x_{t+T-1} & \cdots & x_{t+T-(D-1)} \end{bmatrix} \begin{bmatrix} h_0 \\ h_1 \\ \vdots \\ h_{D-1} \end{bmatrix}$$

The linear LS solution minimization is:

$$\min \sum_t \left( y_t - \sum_{d=0}^{D-1} x_{t-d} h_d \right)^2 = \min \|y - Xh\|^2$$

is achieved as:

$$h=(X^TX)^{-1}X^Ty$$

In some embodiments, the RIR data may be collected during the performance itself by truncating the analysis block of the block-wise least squares process outlined above to the current frame and estimate new filter weights for each frame. Additionally, the block-wise strategy in real-time operation requires constraining the rate of change in RIR filter parameter between adjacent frames to avoid rapid changes in the projected signals. Furthermore, the truncated block-wise least squares process requires inversing the auto-correlation matrix for each new frame of data.

In some embodiments, real-time RIR estimation may be performed by using a recursive least squares (RLS) algorithm. The modelling error for timeframe t may be specified as:

$$e_t=y_t-\hat{x}_t$$

where $y_t$ is the observed/desired mixture signal.

The cost function to be minimized with respect to filter weights may be expressed as:

$$C(h_t)=\Sigma_{i=0}^{t}\lambda^{t-i}e_i^2, 0<\lambda<1$$

which accumulates the estimation error from past frames with exponential weight $\lambda^{t-i}$. The weight of the cost function can be thought of as a forgetting factor which determines how much past frames contribute to the estimation of the RIR filter weights at the current frame. RLS algorithms where $\lambda<1$ may be referred to in the art as exponentially weighted RLS and $\lambda=1$ may be referred to as growing window RLS.

The RLS algorithm minimizing $C(h_t)=\Sigma_{i=0}^{t}\lambda^{t-i}e_i^2, 0<\lambda<1$ is based on recursive estimation of the inverse correlation matrix $P_t$ of the close-field signal and the optimal filter weights $h_t$ and can be summarized as:

Initialization:

$$h_0=0$$

$$P_0=\delta^{-1}I$$

Repeat for t=1, 2, . . .

$$\alpha_t = y_t - x_t^T h_{t-1}$$

$$g_t = P_{t-1}x_t^* \frac{1}{\lambda + x_t^T P_{t-1} x_t^*}$$

$$P_t = \frac{1}{\lambda P_{t-1}} - \frac{1}{\lambda g_t x_t^T P_{t-1}}$$

$$h_t = h_{t-1} + \alpha_t g_t$$

The initial regularization of the inverse autocorrelation matrix is achieved by defining $\delta$ using a small positive constant, typically from $10^{-2}$ to $10^{1}$. A small $\delta$ value causes faster convergence, whereas a larger $\delta$ value constrains the initial convergence to happen over a longer time period (for example, over a few seconds).

The contribution of past frames to the RIR filter estimate at current frame t may be varied over frequency. Generally, the forgetting factor $\lambda$ acts in a similar way as the analysis window shape in the truncated block-wise least squares algorithm. However, small changes in source position can cause substantial changes in the RIR filter values at high frequencies due to highly reflected and more diffuse sound propagation path. Therefore, the contribution of past frames at high frequencies needs to be lower than at low frequencies. It is assumed that the RIR parameters slowly change at lower frequencies and source evidence can be integrated over longer periods, meaning that the exponential weight $\lambda^{t-i}$ can have substantial values for frames up to 1.5 seconds in past.

A similar regularization as described above with reference to block-wise LS may also be adopted for the RLS algorithm. The regularization is done to achieve a similar e□ect as in block-wise LS to improve robustness towards low-frequency crosstalk between near-field signals and avoid excessively large RIR weights. The near-field microphones are generally not directive at low frequencies and can pick up fair amount of low-frequency signal content generated by noise source, for example tra□c, loudspeakers etc.

In order to specify regularization of the RIR filter estimates, the RLS algorithm is given in a direct form. In other words, the RLS algorithm is given without using a matrix inversion lemma to derive updates directly to the inverse autocorrelation matrix $P_t$ but for the autocorrelation matrix $R_t$ ($R_t^{-1}=P_t$). The formulation can be found for example from T. van Waterschoot, G. Rombouts, and M. Moonen, "Optimally regularized recursive least squares for acoustic echo cancellation," in *Proceedings of The second annual IEEE BENELUX/DSP Valley Processing Symposium* (SPS-DARTS 2006), Antwerp, Belgium, 2005, pp. 28-29.

The direct form RLS algorithm updates are specified as, Initialization:

$$h_0=0$$

$$R_0=\delta^{-1}I$$

Repeat for t=1, 2, . . . .

$$\alpha_t=y_t-x_t^T h_{t-1}$$

$$R_t=\lambda R_{t-1}+x_t^* x_t^T$$

$$h_t=h_{t-1}+R_t^{-1}x_t^*\alpha_t$$

This algorithm would give the same result as the RLS algorithm discussed above but requires operation for calculating the inverse of the autocorrelation matrix, and is thus computationally more expensive, but does allow regularization of it. The autocorrelation matrix update with Levenberg-Marquardt regularization (LMR) according to T. van Waterschoot, G. Rombouts, and M. Moonen, "Optimally regularized recursive least squares for acoustic echo cancellation," in *Proceedings of The second annual IEEE BENELUX/DSP Valley Processing Symposium* (SPS-DARTS 2006), Antwerp, Belgium, 2005, pp. 28-29 is:

$$R_t=\lambda R_{t-1}+x_t^* x_t^T+(1-\lambda)\beta_{LMR}I$$

where $\beta_{LMR}$ is obtained from the regularization kernel $k_f$ increasing towards low frequencies weighted by the inverse average log-spectrum of the close-field signal $(1-e_f)$ as discussed above with respect to the block-wise LS algorithm.

Another type of regularization is the Tikhonov regularization (TR), as also introduced in the case of block-wise LS, which can defined for the RLS algorithm as:

$$R_t=\lambda R_{t-1}+x_t^* x_t^T+(1-\lambda)\beta_{TR}I$$

$$h_t=h_{t-1}+R_t^{-1}(x_t^*\alpha_t+(1-\lambda)\beta_{TR}h_{t-1})$$

Similarly as before, $\beta_{TR}$ is based on the regularization kernel and the inverse average log-spectrum of the close-field signal. It should be noted that the kernel $k_f$ needs to be modified to account for the di□erences between block-wise LS and RLS algorithms, and can depend on the level di□erence between the close-field signal and the far-field mixtures.

In addition to regularization weight being adjusted based on the average log-spectrum, it can also be varied based on the RMS level difference between near-field and far-field signals. The RMS levels of these signals might not be calibrated in real-time operation and thus additional regularization eight strategy is required. A low-pass filter applied to RMS of each individual STFT frame can be used to track the varying RMS level of close-field and far-field signals. The estimated RMS level is used to adjust the regularization weights $\beta_{LMR}$ or $\beta_{TR}$ in order to achieve similar regularization impact as with RMS calibrated signals assumed in earlier equations.

A RIR filter related to the position of the target source is identified and may be passed to a projector.

In some embodiments the content processor 101 comprises a projector, for example projector 1 211 which is a projector associated with the array microphone 1 and the external microphone 1.

The projector 1 thus applies the determined or identified room impulse response filter to the 'dry' external microphone audio signal to project the near-field audio signal into a far-field space and thus generate a 'wet' projection of the external microphone audio signal. The projection audio signal may be passed to the filter 1 215 and also provide the wet projection audio signal 223.

For example the projected 'wet' audio signal for a single block can be obtained as:

$$\hat{x}_t = \sum_{d=0}^{D-1} x_{t-d} h_d$$

$$\hat{x}_t^{(p)} = \sum_{d=0}^{D-1} x_{t-d}^{(p)} h_d^{(p)}$$

The content processor 101 may comprise filters, shown in FIG. 2 as filter 1 215 configured to receive the output of projector 1 211. The filters are configured to subtract the output of the projectors from the array microphone audio input. The removal of a particular 'wet' projection of the external microphone audio signal from the array audio signals is a simple subtraction:

$$\hat{y}_t = y_t - \hat{x}_t$$

This residual audio signal may then be output.

In some embodiments the content processor may implement a time-alignment method, which would perform time alignment of the microphone array audio signal and the external microphone audio signals if they cannot be time-synchronized based on time of capture information. The time-alignment can be based on known methods of audio cross correlation and is implemented to align the microphone array audio content and external microphone audio content to the same time line so that they can be reproduced jointly.

The RIR estimation presented in embodiments of the present invention allows removal of an external microphone audio signal target source from the audio mixture or an addition of the external a source to the audio mixture of the far-field audio recording device 101. Based on target source direction of arrival (DOA) trajectory or location estimates of the target source, the signal emitted by the source can be replaced by augmenting separate content to the array mixture of the far-field audio recording device 101.

Figure 3:
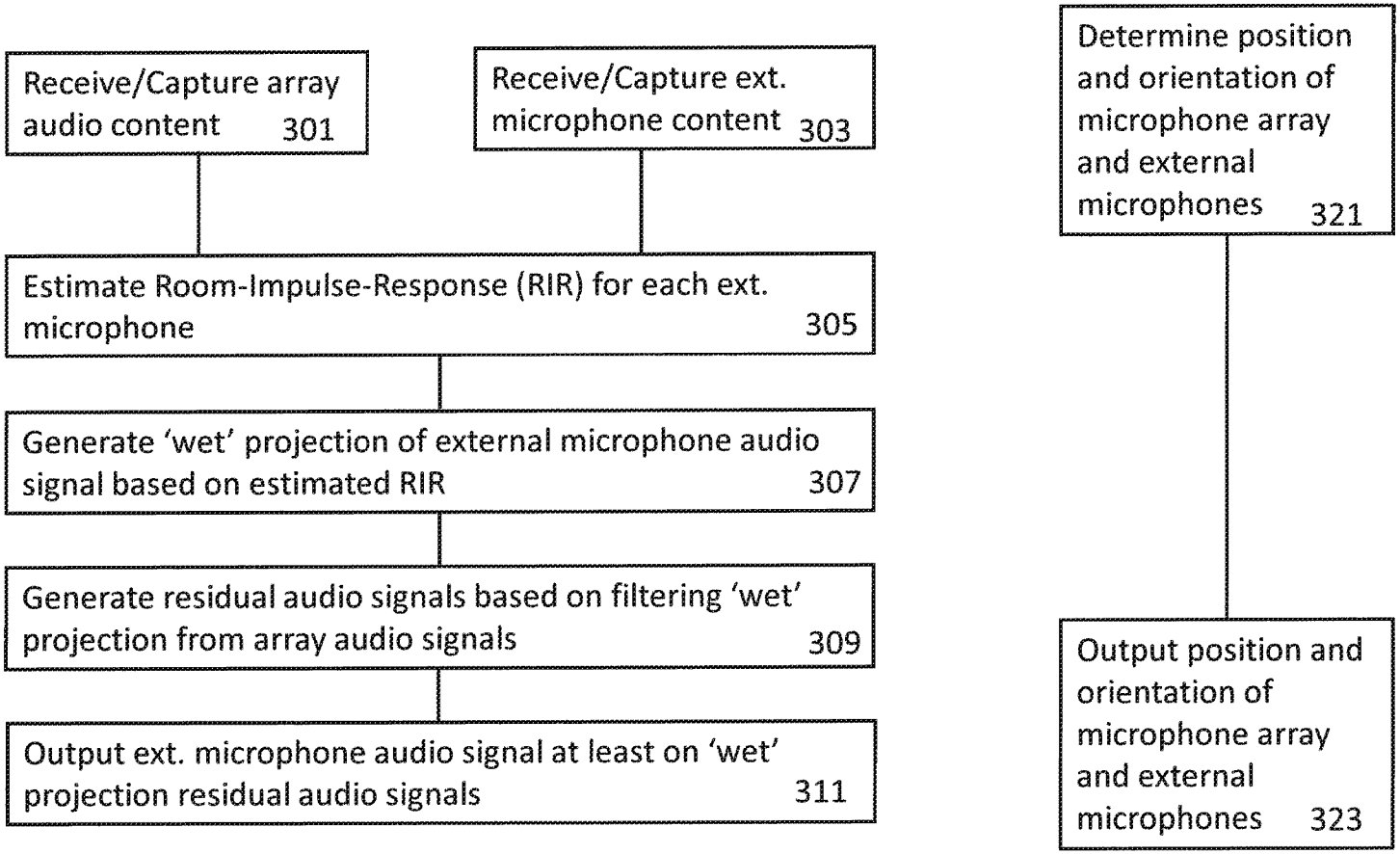
FIG. 3 shows a flow diagram of the operations of the volumetric audio signal capture apparatus according to some embodiments.

With respect to FIG. 3 a flow diagram of the operations of some embodiments implementing the system of capture of volumetric audio is shown.

In some embodiments the array audio content is captured or received.

The operation of capturing or receiving the array audio content is shown in FIG. 3 by step 301.

Similarly the external microphone audio content is captured or received.

The operation of capturing or receiving the external microphone audio content is shown in FIG. 3 by step 303.

Furthermore the position and/or orientation of the microphone array and/or the external microphones is determined. The determination of the orientation and position information is an optional operation. The determination may be required if, during playback, the positions of the external microphones are to be the same as during recording. However as the sound sources may be placed freely in the listening environment the original position and orientation information may not be needed.

The determining of the position and/or orientation of the microphone array and/or the external microphones is shown in FIG. 3 by step 321.

The capture method may then estimate the room-impulse-response for each external microphone audio signal based on the external microphone audio signal, microphone array audio signals.

The estimating of the room-impulse-response parameters is shown in FIG. 3 by step 305.

The capture method may then be configured to generate a 'wet' projection of the external microphone audio signal based on the external microphone audio signal and the room-impulse-response parameters.

The operation of generating the 'wet' projection is shown in FIG. 3 by step 307.

The capture method may then be configured to generate a residual audio signal based on subtracting the 'wet' projection of the external microphone audio signal from the microphone array audio signals.

The operation of generating the residual audio signals is shown in FIG. 3 by step 309.

In some embodiments the capture method may then be configured to output, for example for storage or transmission the at least one external microphone audio signal, the associated at least one 'wet' projection audio signal and the residual audio signal.

The outputting of the at least one external microphone audio signal, the associated at least one 'wet' projection audio signal and the residual audio signal is shown in FIG. 3 by step 311.

Furthermore the capture method may then be configured to output, for example for storage or transmission, the position and/or orientation of the microphone array and/or the external microphones.

The outputting of the position and/or orientation of the microphone array and/or the external microphones is shown in FIG. 3 by step 323.

Figure 4:
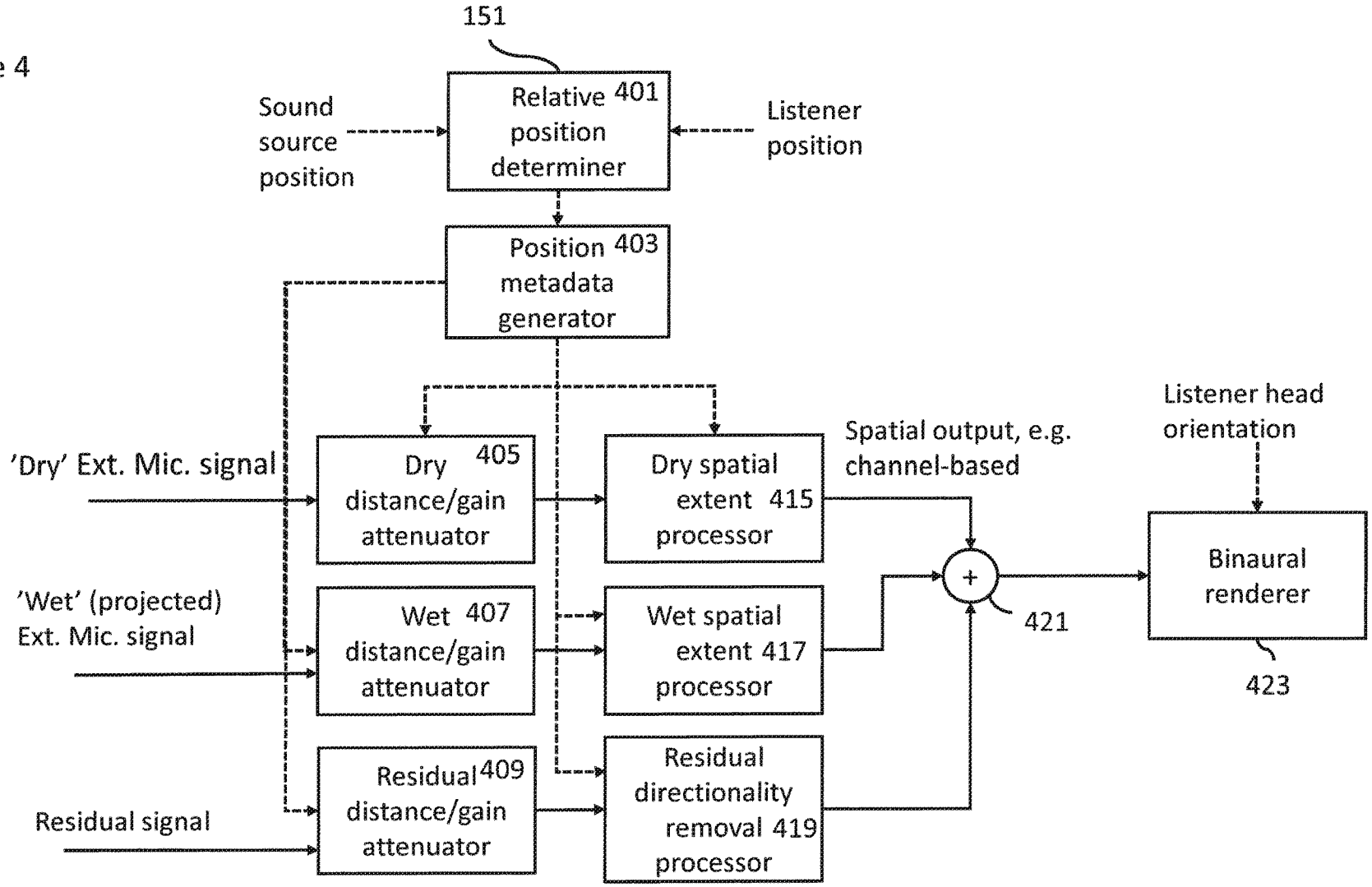
FIG. 4 shows schematically volumetric audio signal reproduction apparatus suitable for generating personal volumetric spatial audio as shown in FIG. 1 according to some embodiments.

With respect to FIG. 4 an example volumetric audio signal reproduction apparatus suitable for generating personal volumetric spatial audio is shown.

As described the volumetric audio signal reproduction apparatus may in some embodiments be implemented as part of the playback device.

The volumetric audio signal reproduction apparatus in some embodiments comprises a relative position determiner 401. The relative position determiner 401 may be configured to receive the external microphone position and/or orientation and the listener position and/or orientation and be configured to determine the external microphone position with respect to the listener. In some embodiments this may be performed in two stages. The first stage is one of recalculating the external microphone (or source) position taking into account the listener translation. The second stage is one of determining the external microphone position with respect to the listener (for example the head) orientation. Thus given a listener position and external microphone (source) position in Cartesian coordinates (x, y, z), the system first calculates the external microphone (source) position in polar coordinates (azimuth, elevation, distance) with respect to the current listener position.

The relative position determiner 401 in some embodiments is configured to output the relative position information to a position metadata generator 403.

The volumetric audio signal reproduction apparatus in some embodiments further comprises a position metadata generator 403. The position metadata generator may be configured to receive the relative position information and generate suitable control signals to the attenuators and processors described hereafter.

In some embodiments the volumetric audio signal reproduction apparatus comprises a 'dry' audio signal distance/gain attenuator 405. The 'dry' audio signal distance/gain attenuator 405 in some embodiments is configured to receive the 'dry' external microphone audio signal and the output of the position metadata generator 403. The output of the 'dry' audio signal distance/gain attenuator 405 is passed to a 'dry' spatial extent processor 415.

In some embodiments the volumetric audio signal reproduction apparatus comprises a 'wet' audio signal distance/gain attenuator 407. The 'wet' audio signal distance/gain attenuator 407 in some embodiments is configured to receive the 'wet' projected external microphone audio signal and the output of the position metadata generator 403. The output of the 'wet' audio signal distance/gain attenuator 407 is passed to a 'wet' spatial extent processor 417.

In some embodiments the 'dry' audio signal distance/gain attenuator 405 and 'wet' audio signal distance/gain attenuator 407 are configured to adjust the gain for the 'dry' external microphone audio signal relative to the projected 'wet' external microphone audio signal. For example, in some embodiments the 'dry' external microphone audio signal gain may be set such that it is inversely proportional to the distance, that is, gain=1.0/distance.

In some embodiments the volumetric audio signal reproduction apparatus comprises a residual audio signal distance/gain attenuator 409. The residual audio signal distance/gain attenuator 409 in some embodiments is configured to receive the residual audio signal and the output of the position metadata generator 403. The gain of the residual audio signal may be based on the relative distance between the array microphone (the position of the microphone array and the listener). The output of the residual audio signal distance/gain attenuator 407 is passed to a residual directionality removal processor 419.

In some embodiments, for the wet projection external microphone audio signal and the diffuse residual audio signal, the distance/gain attenuation may have an effect only when the listener is farther than a predefined threshold from the capture setup. The threshold may be defined by defining a boundary around the capture apparatus (for example relative to the microphone array position), which may correspond to, for example, to the locations of physical walls where the capture was done. Alternatively in some embodiments it might be an artificial boundary. When the listener is outside this boundary, distance/gain attenuation is applied as gain=1/sqrt(distance_from_boundary).

In some embodiments the volumetric audio signal reproduction apparatus comprises a 'dry' spatial extent processor 415. The 'dry' spatial extent processor 415 is configured to receive the output of the 'dry' audio signal distance/gain attenuator 405 and the output of the position metadata generator 403. The output of the 'dry' spatial extent processor 415 is passed to a combiner 421.

In some embodiments the volumetric audio signal reproduction apparatus comprises a 'wet' spatial extent processor 417. The 'wet' spatial extent processor 417 is configured to receive the output of the 'wet' audio signal distance/gain attenuator 407 and the output of the position metadata generator 403. The output of the 'wet' spatial extent processor 417 is passed to the combiner 421.

In some embodiments the volumetric audio signal reproduction apparatus comprises a residual directionality removal processor 419. The residual directionality removal processor 419 is configured to receive the output of the residual audio signal distance/gain attenuator 409 and the output of the position metadata generator 403. The output of the residual directionality removal processor 419 is passed to the combiner 421.

The spatial extent processors and directionality removal processor may be configured to perform two actions on the audio signals. Firstly they spatially position the external microphone (source) given the azimuth and elevation from the listener. Secondly they control the spatial extent (width or size) of the external microphone sources and the residual environmental audio signals as necessary.

For example the 'wet' spatial extent processor 417 may be configured to process the 'wet' projection of the external microphone audio signal such that the audio signals is reproduced with a defined spatial extent (for example 180 degrees) the processor may then be configured to expand the spatial extent of the audio signal such that the audio signal spatial extent is wider at longer distances and narrower when the listener is closer to the source.

In some embodiments the 'dry' spatial extent processor 415 is configured to process the 'dry' external microphone audio signals such that it has a larger spatial extent when it is closer. In other words the audio signal is reproduced spatially extended (in other words with a spatial extent larger than 0 degrees) when the external microphone (source) is close to the listener but is reproduced with a narrowing extent after a certain distance threshold is reached. An example of such threshold is one where the direct-to-reverberant ratio (DRR) is smaller than 0.1, the dry signal extent is configured to be narrower. In some embodiments the narrowing can be configured to be gradual and may in some embodiments linearly follow the energy of the 'dry external microphone audio signal. For example the transform may be linearly based on the change of DRR so that after another threshold the spatial extent of the 'dry' projection of the external microphone audio signals is point-like. In particular, if the source is inhabiting the same virtual space as the listener, the 'wet' spatial extent processor 417 may be configured to generate a completely surrounding (360 degrees extent) output. When the distance from the listener grows, the spatial extent of the external microphone audio signal (source) becomes smaller. The processor may be configured in some embodiments to achieve this by using the inverse of distance from the listener as a factor to scale a spatial extent parameter. The processor may be configured in some embodiments to achieve this in a more natural solution if a virtual volume (i.e., size) is given to the source and then the spatial extent represents the largest angle between all vectors from the listening point to the edges of the virtual volume. In some embodiments this the spatial extent may be corrected with a predefined spatial extent correction factor so that the perceived extent corresponds to the size of the object.

The residual directionality removal processor 419 may in some embodiments be configured to process the residual audio signal such that the residual audio signal is spatially extended to 360 degrees or other suitable amount. In addition to spatially extending the residual audio signal, this spatial extension effectively removes the directionality from the residual audio signal. As the directionality is removed along with the most dominant sources, the residual audio signals comprise mostly diffuse ambiance audio signals and any change to the listener's position does not change the audio signal, except when the listener's position is very far from the capture. At such 'extreme' distances and thus when the listener to source distance is greater than a 'far' threshold the residual directionality removal processor 419 may be configured to start to decrease the spatial extent of the residual proportionally to the distance. For example, the spatial extent may be scaled by the inverse of the distance from the limit where it starts to decrease.

The output from the spatial extent processors and directionality removal processor may be in a spatial format. For example the output of the processors may be in a loudspeaker (such as 4.0) format.

In some embodiments the volumetric audio signal reproduction apparatus comprises a combiner 421 configured to receive the outputs from the 'dry' spatial extent processor 415, the 'wet' spatial extent processor 417 and residual directionality removal processor 419 and provided a combined or summed output. The combined spatial outputs may then in some embodiments be passed to a binaural renderer 423.

The volumetric audio signal reproduction apparatus in some embodiments comprises a binaural renderer 423 configured to receive the output of the combiner 421 and the listener head orientation (for example from the head tracker). A binaural rendering of the combined audio signals takes into account the user head orientation (yaw, pitch, roll) and determines the appropriate head-related-transfer-function (HRTF) filters for the left and right ear for each loudspeaker channel, and creates a signal suitable for headphone listening. Thus the binaural renderer 423 may be configured to output the renderer audio signal to the listener and the headphones 153.

Figure 5:
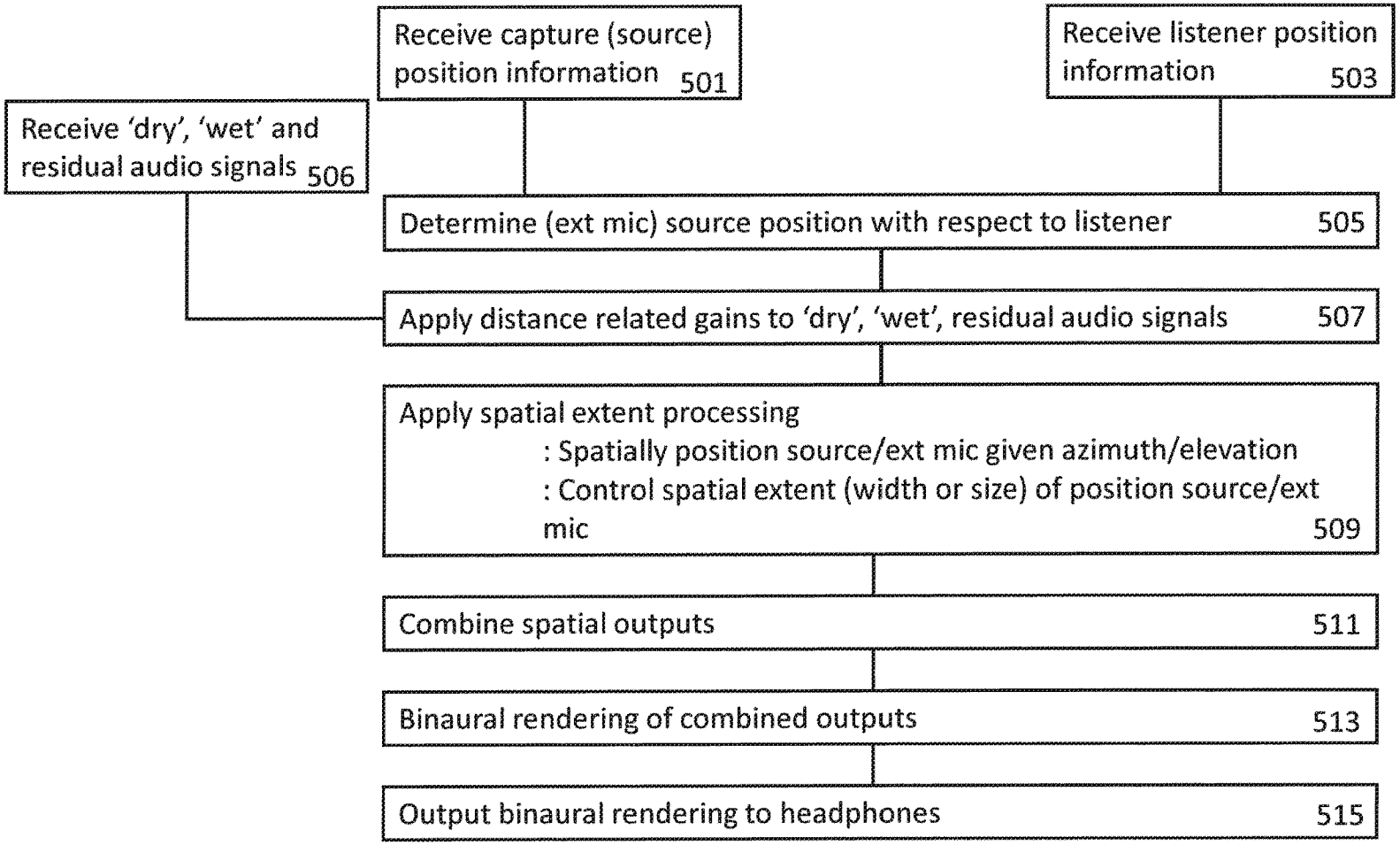
FIG. 5 shows a flow diagram of the operations of the volumetric audio signal reproduction apparatus according to some embodiments.

With respect to FIG. 5 a summary of the operations performed within the volumetric audio signal reproduction apparatus according to some embodiments is shown.

In some embodiments the capture position/orientation information, for example the external microphone (source) position/orientation information (and in some embodiments the microphone array position/orientation information), is received. In some embodiments source position definitions other than the capture orientation/position information may be used for the source positions. For example in some embodiments a static pre-defined position template may be used or the source positions may be defined using some artistically pleasing route.

The receiving of the capture position/orientation information is shown in FIG. 5 by step 501.

In some embodiments the playback (listener) position/orientation information is received.

The receiving of the listener position/orientation information is shown in FIG. 5 by step 503.

The external microphone (source) position with respect to the listener is then determined.

The determining of the position/orientation of the source relative to the listener is shown in FIG. 5 by step 505.

The 'dry', 'wet' and residual audio signals may be received.

The receiving of the 'dry', 'wet' and the residual audio signals is shown in FIG. 5 by step 507.

The effect of the distance related gains are then applied to the 'dry', 'wet' and the residual audio signals.

The application of the distance related gains between the source and the listener positions to the 'dry', 'wet' and the residual audio signals is shown in FIG. 5 by step 507.

The effect of distance and direction related spatial extent processing is then applied to the 'dry', 'wet' and the residual audio signals. This for example may involve spatially positioning source/external microphone given an azimuth/elevation determination and furthermore controlling the spatial extent (width or size) of position source/external microphone based on the distance.

The application of distance and direction related spatial extent processing to the 'dry', 'wet' and the residual audio signals is shown in FIG. 5 by step 509.

The spatially processed audio signals may then be combined.

The combination of the spatially processed audio signals is shown in FIG. 5 by step 511.

The combined spatially processed audio signals may then be binaurally rendered.

The binaural rendering of the spatially processed audio signals is shown in FIG. 5 by step 513.

The binaurally rendered audio signals may be output, for example to the listener's headphones.

The outputting of the binaural audio signals to the headphones of the listener is shown in FIG. 5 by step 515.

Figure 6:
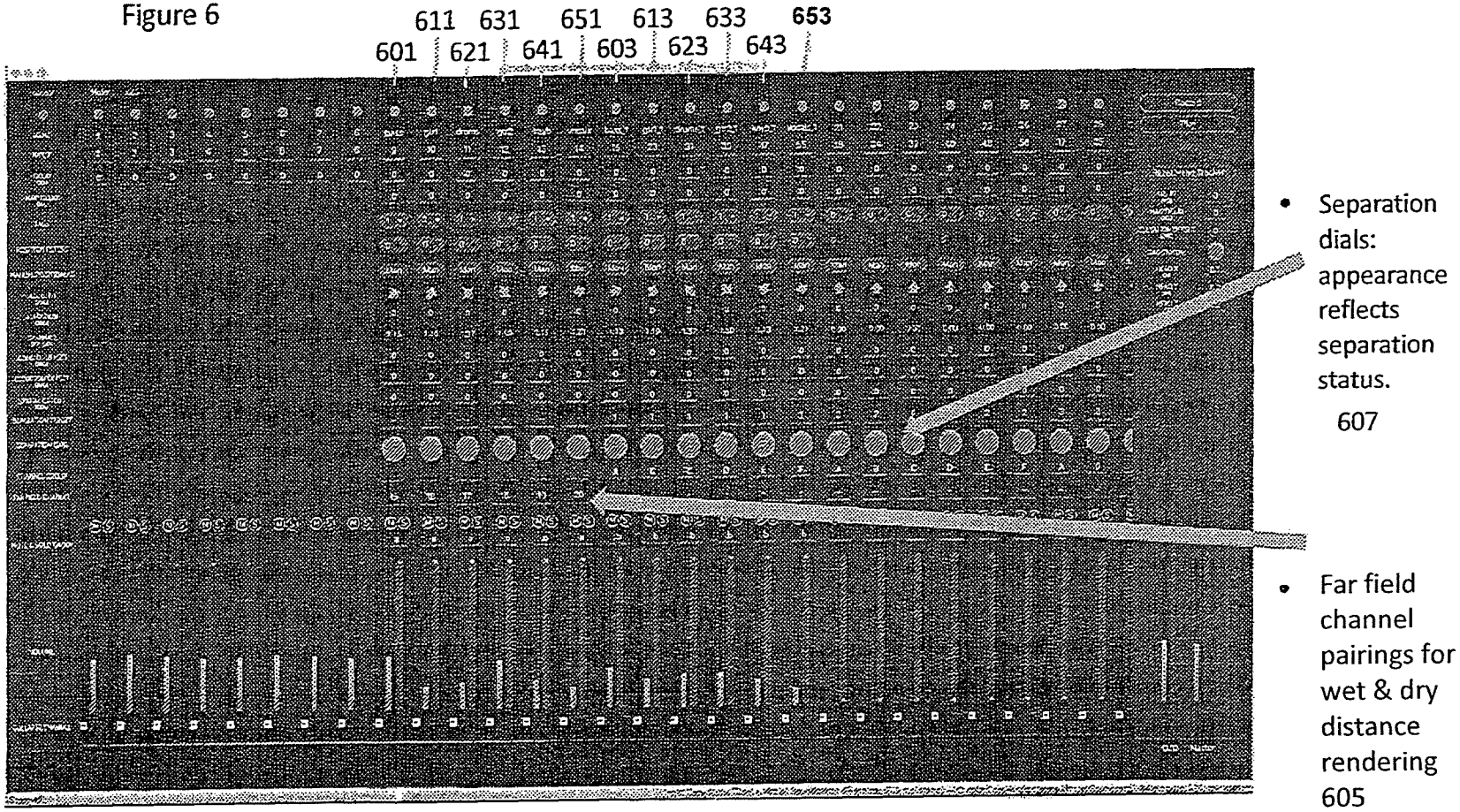
FIG. 6 shows schematically a user interface implementation for controlling the content processor as shown in FIG. 2 according to some embodiments.

With respect to FIG. 6 an example digital audio workstation (DAW) user interface (UI) is shown which can be used to control the system. In this example each audio signal is input to a channel and channel controls are collected into a channel strip. Each dry external microphone (lavalier) audio signal is input as a channel. Thus for example an external microphone associated with a bass guitar is input to the channel 601, an external microphone associated with a first electric guitar is input to the channel 611, an external microphone associated with a drum set is input to the channel 621, an external microphone associated with a second electric guitar is input to the channel 631, an external microphone associated with a keyboard is input to the channel 641 and an external microphone associated with a vocalist is input to the channel 651.

Each 'dry' external microphone audio signal has a 'wet' pair which takes the projected signal as input. This is represented in FIG. 5 by the channel pairing information 605 in the 'dry' channel identifying the 'wet' channel.

Thus for example a 'wet' projection of the bass guitar is input to the channel 603, a 'wet' projection of the first electric guitar is input to the channel 613, a 'wet' projection of the drum set is input to the channel 623, a 'wet' projection of the second electric guitar is input to the channel 633, a 'wet' projection of the keyboard is input to the channel 643 and a 'wet' projection of the vocalist is input to the channel 653.

Different processing is applied to the dry signals and the wet signals as described above. Moreover, in this DAW configuration the amount of separation can be controlled. For example the separation can be controlled using the knob controllers 607 to adjust the degree of removal of the wet projections from the diffuse residual.

Figure 7:
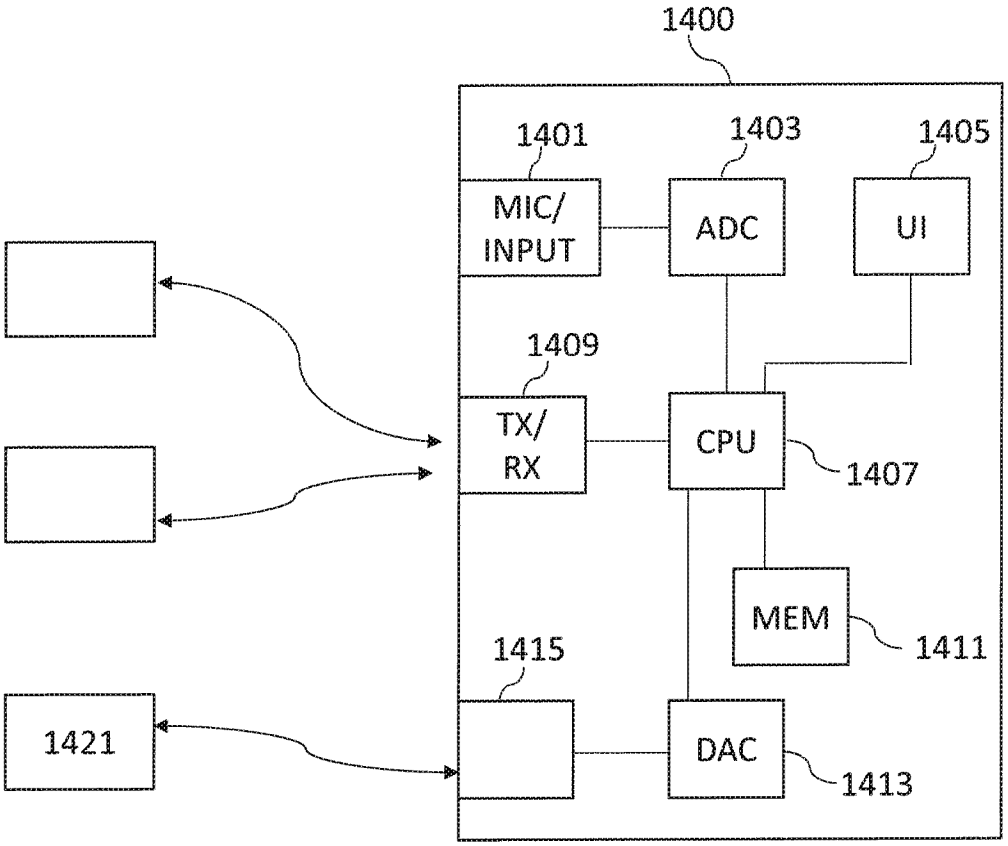
FIG. 7 shows schematically an example device suitable for implementing the apparatus shown in previous figures.

With respect to FIG. 7 an example electronic device which may be used as the capture device and/or audio signal analyser/processor and/or playback device is shown. The device may be any suitable electronics device or apparatus. For example in some embodiments the device 1400 is a mobile device, user equipment, tablet computer, computer, audio playback apparatus, etc.

The device 1400 may comprise a microphone or microphone array 1401. The microphone or microphone array 1401 may comprise a plurality (for example a number N) of microphone elements. However it is understood that there may be any suitable configuration of microphones and any suitable number of microphones. In some embodiments the microphone or microphone array 1401 is separate from the apparatus and the audio signal transmitted to the apparatus by a wired or wireless coupling. The microphone or microphone array 1401 may in some embodiments be the microphone array as shown in the previous figures.

The microphone or microphone array may comprise transducers configured to convert acoustic waves into suitable electrical audio signals. In some embodiments the microphone or microphone array may comprise solid state microphones. In other words the microphones may be capable of capturing audio signals and outputting a suitable digital format signal. In some other embodiments the microphone or microphone array 1401 can comprise any suitable microphone type or audio capture means, for example condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphone or microphone array can in some embodiments output the audio captured signals to an analogue-to-digital converter (ADC) 1403.

The device 1400 may further comprise an analogue-to-digital converter 1403. The analogue-to-digital converter 1403 may be configured to receive the audio signals from each microphone 1401 and convert them into a format suitable for processing. In some embodiments where the microphone or microphone array comprises integrated microphone the analogue-to-digital converter is not required. The analogue-to-digital converter 1403 can be any suitable analogue-to-digital conversion or processing means. The analogue-to-digital converter 1403 may be configured to output the digital representations of the audio signals to a processor 1207 or to a memory 1411.

In some embodiments the device 1400 comprises at least one processor or central processing unit 1207. The processor 1407 can be configured to execute various program codes such as the methods such as described herein.

In some embodiments the device 1400 comprises a memory 1411. In some embodiments the at least one processor 1407 is coupled to the memory 1411. The memory 1411 can be any suitable storage means. In some embodiments the memory 1411 comprises a program code section for storing program codes implementable upon the processor 1407. Furthermore in some embodiments the memory 1411 can further comprise a stored data section for storing data, for example data that has been processed or to be processed in accordance with the embodiments as described herein. The implemented program code stored within the program code section and the data stored within the stored data section can be retrieved by the processor 1407 whenever needed via the memory-processor coupling.

In some embodiments the device 1400 comprises a user interface 1405. The user interface 1405 can be coupled in some embodiments to the processor 1407. In some embodiments the processor 1407 can control the operation of the user interface 1405 and receive inputs from the user interface 1405. In some embodiments the user interface 1405 can enable a user to input commands to the device 1400, for example via a keypad. In some embodiments the user interface 1405 can enable the user to obtain information from the device 1400. For example the user interface 1405 may comprise a display configured to display information from the device 1400 to the user. The user interface 1405 can in some embodiments comprise a touch screen or touch interface capable of both enabling information to be entered to the device 1400 and further displaying information to the user of the device 1400. In some embodiments the user interface 1405 may be the user interface for communicating with the position determiner as described herein.

In some implements the device 1400 comprises a transceiver 1409. The transceiver 1409 in such embodiments can be coupled to the processor 1407 and configured to enable a communication with other apparatus or electronic devices, for example via a wireless communications network. The transceiver 1409 or any suitable transceiver or transmitter and/or receiver means can in some embodiments be configured to communicate with other electronic devices or apparatus via a wire or wired coupling.

For example the transceiver 1409 may be configured to communicate with the renderer as described herein.

The transceiver 1409 can communicate with further apparatus by any suitable known communications protocol. For example in some embodiments the transceiver 1409 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the device 1400 may be employed as at least part of the audio processor. As such the transceiver 1409 may be configured to receive the audio signals and positional information from the capture device microphones or microphone array and in some embodiments determine the parameters as described herein by using the processor 1407 executing suitable code. Furthermore the device may generate a suitable audio signal and parameter output to be transmitted to the renderer or spatial processing device.

In some embodiments the device 1400 may be employed as at least part of the renderer. As such the transceiver 1409 may be configured to receive the audio signals from the microphones or microphone array and in some embodiments the parameters determined at the capture device or processing device as described herein, and generate a suitable audio signal rendering by using the processor 1407 executing suitable code. The device 1400 may comprise a digital-to-analogue converter 1413. The digital-to-analogue converter 1413 may be coupled to the processor 1407 and/or memory 1411 and be configured to convert digital representations of audio signals (such as from the processor 1407 following an audio rendering of the audio signals as described herein) to a suitable analogue format suitable for presentation via an audio subsystem output. The digital-to-analogue converter (DAC) 1413 or signal processing means can in some embodiments be any suitable DAC technology.

Furthermore the device 1400 can comprise in some embodiments an audio subsystem output 1415. An example as shown in FIG. 7 shows the audio subsystem output 1415 as an output socket configured to enabling a coupling with headphones 1421. However the audio subsystem output 1415 may be any suitable audio output or a connection to an audio output. For example the audio subsystem output 1415 may be a connection to a multichannel speaker system.

In some embodiments the digital to analogue converter 1413 and audio subsystem 1415 may be implemented within a physically separate output device. For example the DAC 1413 and audio subsystem 1415 may be implemented as cordless earphones communicating with the device 1400 via the transceiver 1409.

Although the device 1400 is shown having both audio capture, audio processing and audio rendering components, it would be understood that in some embodiments the device 1400 can comprise just some of the elements.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus for audio signal rendering comprising:

at least one processor; and at least one non-transitory memory and computer program code, wherein the at least one memory and the computer program code are configured to, with the at least one processor, cause the apparatus to:

receive at least one microphone audio signal captured with at least one microphone within a capture environment;

receive at least one projection audio signal, wherein the at least one projection audio signal is a room-impulse-response filtered at least one microphone audio signal captured within the capture environment;

receive at least one residual audio signal, wherein the at least one residual audio signal is a result of removing the at least one projection audio signal from at least one audio signal captured with at least one further microphone within the capture environment; and generate a spatial audio signal based on the at least one microphone audio signal, the at least one projection audio signal and the at least one residual audio signal.

2. The apparatus as claimed in claim 1, wherein the at least one memory and the computer program code are further configured to, with the at least one processor, cause the apparatus to at least one of:

determine listener position information; or determine relative position information based on the listener position information and an audio source position information.

3. The apparatus as claimed in claim 2, wherein the at least one memory and the computer program code are further configured to, with the at least one processor, cause the apparatus to determine position information associated with the at least one microphone, wherein the audio source position information is based on the determined position information associated with the at least one microphone.

4. The apparatus as claimed in claim 2, wherein the at least one memory and the computer program code are further configured to, with the at least one processor, cause the apparatus to receive a user input defining the audio source position information.

5. The apparatus as claimed in claim 2, wherein the spatial audio signal comprises at least two spatially located volumetric audio signals, and the at least one memory and the computer program code configured to, with the at least one processor, cause the apparatus to generate the spatial audio signal are further configured to cause the apparatus to generate the at least two spatially located volumetric audio signals based on the determined relative position information.

6. The apparatus as claimed in claim 5, wherein the at least one memory and the computer program code configured to, with the at least one processor, cause the apparatus to generate the at least two spatially located volumetric audio signals are further configured to cause the apparatus to:

apply an associated microphone gain to a respective microphone audio signal of the at least one microphone audio signal based on the determined relative position information; and generate at least two spatially located microphone audio signals for the respective gain adjusted microphone audio signal based on the determined relative position information.

7. The apparatus as claimed in claim 6, wherein the at least one memory and the computer program code configured to, with the at least one processor, cause the apparatus to generate the at least two spatially located volumetric audio signals are further configured to cause the apparatus to:

apply an associated projection gain to a respective projection audio signal of the at least one projection audio signal based on the determined relative position information; and generate at least two spatially located projection audio signals for the respective gain adjusted projection audio signal based on the determined relative position information.

8. The apparatus as claimed in claim 7, wherein the at least one memory and the computer program code configured to, with the at least one processor, cause the apparatus to generate the at least two spatially located volumetric audio signals are further configured to cause the apparatus to:

apply an associated gain to a respective residual audio signal of the at least one residual audio signal based on the determined relative position information; and generate at least two spatially located residual audio signals for the respective gain adjusted residual audio signal based on the determined relative position information.

9. The apparatus as claimed in claim 8, wherein the at least one memory and the computer program code configured to, with the at least one processor, cause the apparatus to generate the at least two spatially located volumetric audio signals are further configured to cause the apparatus to generate at least two spatially located combined audio signals, wherein generating the at least two spatially located combined audio signals comprises combining at least one of:

the at least two spatially located residual audio signals;

the at least two spatially located projection audio signals; or the at least two spatially located microphone audio signals.

10. The apparatus as claimed in claim 9, wherein the at least one memory and the computer program code configured to, with the at least one processor, cause the apparatus to generate the at least two spatially located volumetric audio signals are further configured to cause the apparatus to generate at least two rendered audio signals based on the generated at least two spatially located combined audio signals and a listener orientation.

11. The apparatus as claimed in claim 1, wherein the at least one memory and the computer program code configured to, with the at least one processor, cause the apparatus to receive the at least one projection audio signal are further configured to cause the apparatus to:

determine a room-impulse-response; and apply a filter set with the determined room-impulse-response to the at least one microphone audio signal to generate the at least one projection audio signal.

12. The apparatus as claimed in claim 1, wherein the at least one memory and the computer program code configured to, with the at least one processor, cause the apparatus to receive the at least one residual audio signal are further configured to cause the apparatus to:

receive the at least one audio signal captured with the at least one further microphone; and subtract the at least one projection audio signal from the at least one audio signal captured with the at least one further microphone within the capture environment to generate the at least one residual audio signal.

13. The apparatus as claimed in claim 1, wherein the at least one memory and the computer program code are further configured to, with the at least one processor, cause the apparatus to:

render the generated spatial audio signal to present a perception of the capture environment to a listener in a virtual reality environment, wherein the perception is associated with a position and/or an orientation of the listener in the virtual reality environment.

14. A method for audio signal rendering, the method comprising:

receiving at least one microphone audio signal captured with at least one microphone within a capture environment;

receiving at least one projection audio signal, wherein the at least one projection audio signal is a room-impulse-response filtered at least one microphone audio signal captured within the capture environment;

receiving at least one residual audio signal, wherein the at least one residual audio signal is a result of removing the at least one projection audio signal from at least one audio signal captured with at least one further microphone within the capture environment; and generating a spatial audio signal based on the at least one microphone audio signal, the at least one projection audio signal and the at least one residual audio signal.

15. The method as claimed in claim 14, further comprising at least one of:

determining listener position information; or determining relative position information based on the listener position information and an audio source position information.

16. The method as claimed in claim 15, further comprising determining position information associated with the at least one microphone, wherein the audio source position information is based on the determined position information associated with the at least one microphone.

17. The method as claimed in claim 15, further comprising receiving a user input defining the audio source position information.

18. The method as claimed in claim 15, wherein generating the spatial audio signal further comprises generating at least two spatially located volumetric audio signals based on the determined relative position information.

19. The method as claimed in claim 18, wherein generating the at least two spatially located volumetric audio signals further comprises:

applying an associated microphone gain to a respective microphone audio signal of the at least one microphone audio signal based on the determined relative position information; and generating at least two spatially located microphone audio signals for the respective gain adjusted microphone audio signal based on the determined relative position information.

20. The method as claimed in claim 19, wherein generating the at least two spatially located volumetric audio signals further comprises:

applying an associated projection gain to a respective projection audio signal of the at least one projection audio signal based on the determined relative position information; and generating at least two spatially located projection audio signals for the respective gain adjusted projection audio signal based on the determined relative position information.

21. The method as claimed in claim 20, wherein generating the at least two spatially located volumetric audio signals further comprises:

applying an associated gain to a respective residual audio signal of the at least one residual audio signal based on the determined relative position information; and generating at least two spatially located residual audio signals for the respective gain adjusted residual audio signal based on the determined relative position information; and combining the at least two spatially located residual audio signals, the at least two spatially located projection audio signals, and the at least two spatially located microphone audio signals to generate at least two spatially located combined audio signals.

* * * * *